United States Patent [19]

Wright

[11] 4,029,312

[45] June 14, 1977

[54] EXERCISING DEVICE

[76] Inventor: Forrest S. Wright, Apt. 307, 2821 Patrick Henry Drive, Auburn Heights, Mich. 48057

[22] Filed: Dec. 22, 1975

[21] Appl. No.: 642,901

[52] U.S. Cl. ..... 272/123; 272/122; 272/124

[51] Int. Cl.[2] ..... A63B 11/02; A63B 13/00

[58] Field of Search ..... 272/117, 122, 123, 124; 273/67 R

[56] References Cited

UNITED STATES PATENTS

| | | | |
|---|---|---|---|
| 259,752 | 6/1882 | Fisher | 272/122 |
| 660,962 | 10/1900 | Kennedy | 272/122 |
| 793,101 | 6/1905 | Schmidt | 272/122 |
| 808,706 | 1/1906 | Villedrouin | 272/122 |
| 980,025 | 12/1910 | Titus | 272/122 |
| 983,372 | 2/1911 | Johnson | 272/123 |
| 1,044,018 | 11/1912 | Calvert | 272/122 |
| 1,270,034 | 6/1918 | Krudop | 272/123 |
| 1,316,683 | 9/1919 | Calvert | 272/122 |
| 1,366,200 | 1/1921 | Matysek | 272/123 |
| 3,226,117 | 12/1965 | Walklet | 272/123 |
| 3,231,270 | 1/1966 | Winer | 272/123 |
| 3,311,374 | 3/1967 | Wittenberg et al. | 272/123 |
| 3,334,899 | 8/1967 | Bosko et al. | 272/122 |
| 3,336,029 | 8/1967 | London | 273/67 R |
| 3,572,702 | 3/1971 | Dorn | 272/123 |

*Primary Examiner*—Richard J. Apley
*Attorney, Agent, or Firm*—Cullen, Settle, Sloman & Cantor

[57] ABSTRACT

A weight-lifting or exercising device wherein the spacing of the weights along the length of the bar and the masses of the individual weights may be selectively varied to accommodate people of different sizes and capabilities. Each of the weights is substantially hollow and includes a generally ovoid or egg-shaped shell. Each shell has a first axis, a central aperture transverse to the first axis, and a tubular member aligned with the axis and extending across the aperture. A channel opens at one longitudinal end of the shell and extends along the axis and through the tubular member for telescopically receiving the bar therein. The aperture is adapted to receive a person's hand or foot to operatively engage the tubular member for exercising purposes and the weights may be used without the bar as individual dumbbells. The shells may be telescoped along the bar and selectively locked at spaced locations along its length. The shells also include compartments which can be filled or emptied of foreign materials such as water, sand, shot or the like to selectively increase or decrease the mass of the individual weights.

14 Claims, 13 Drawing Figures

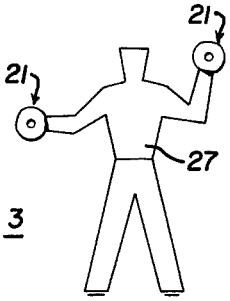
FIG. 3
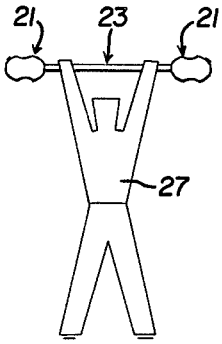
FIG. 4
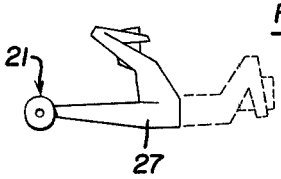
FIG. 6
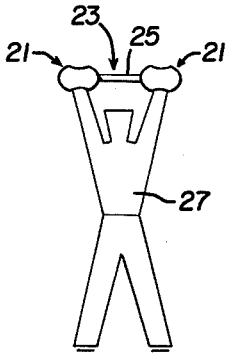
FIG. 5
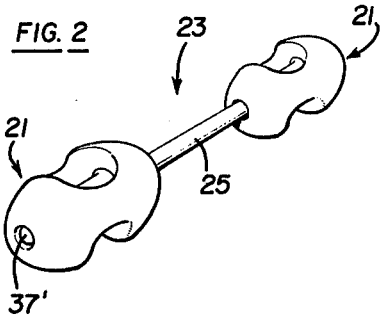
FIG. 2
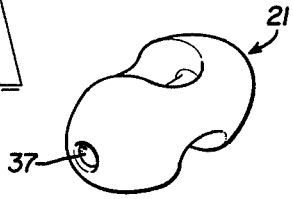
FIG. 1
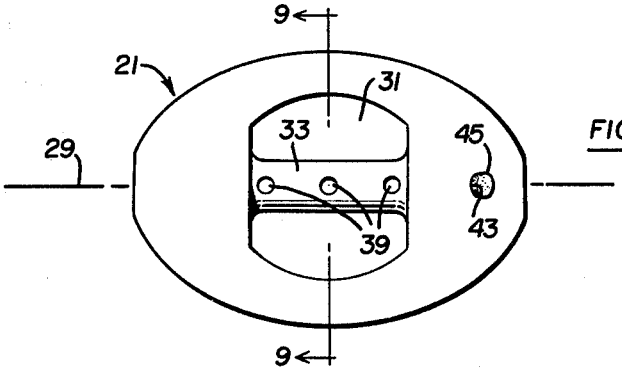
FIG. 7
FIG. 9
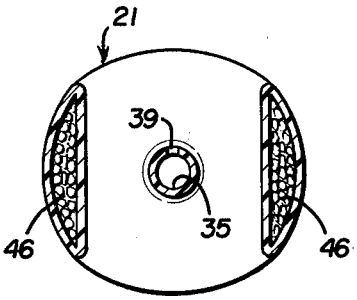
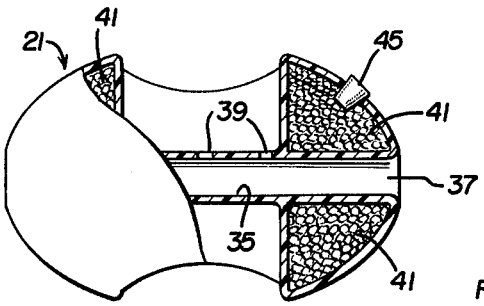
FIG. 8

FIG. 10
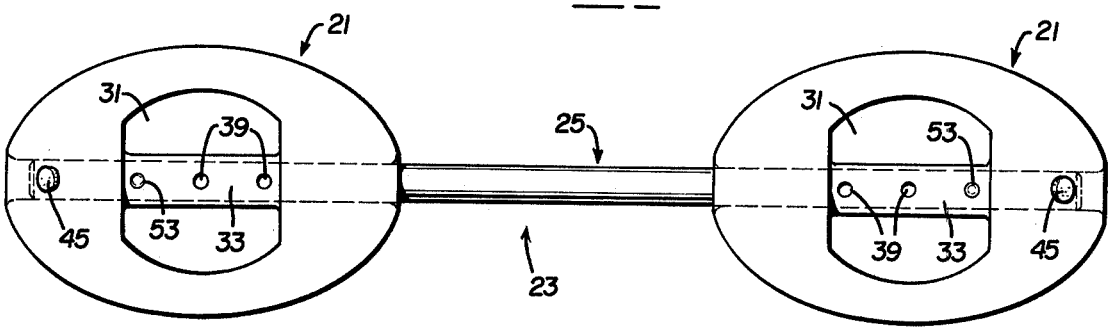
FIG. 13
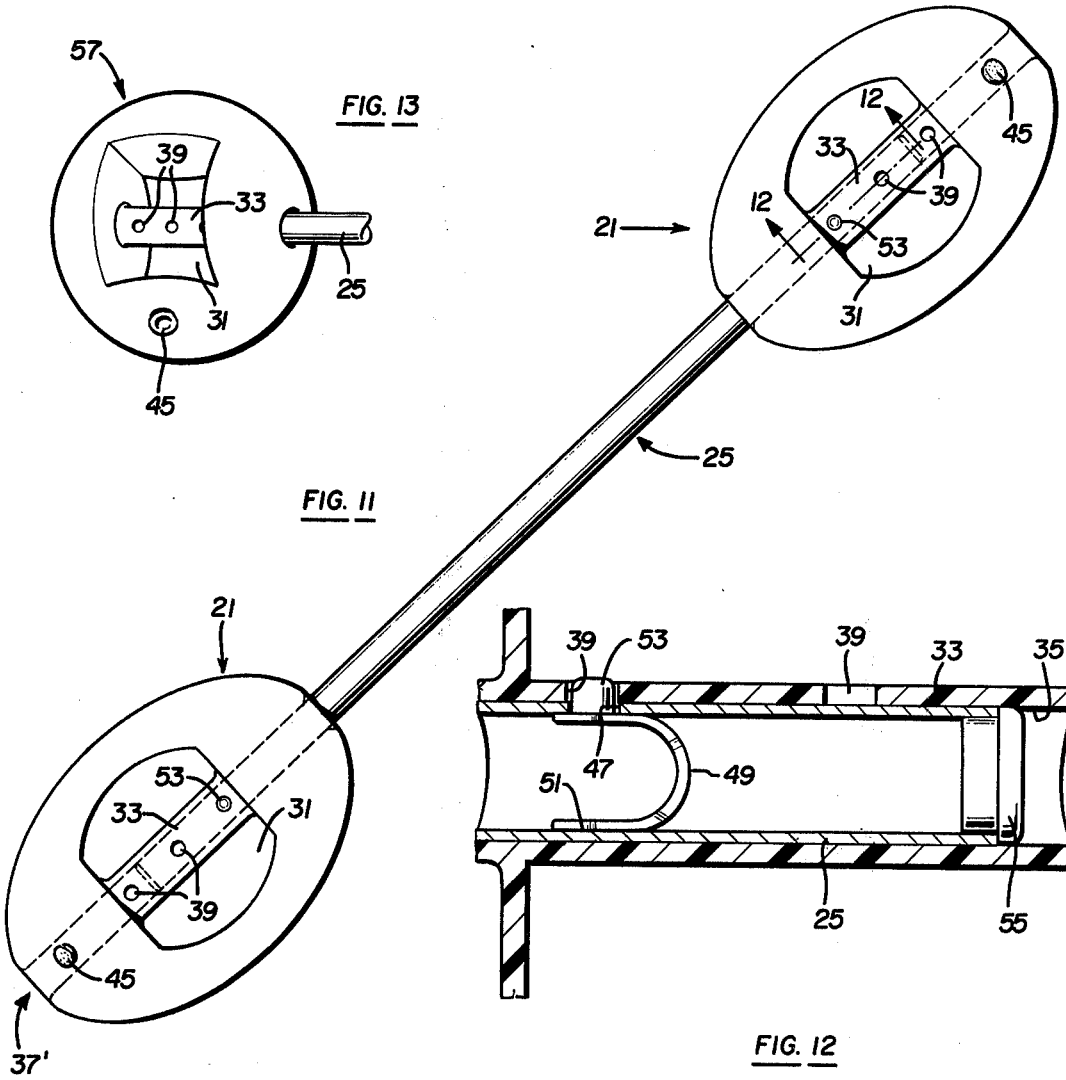
FIG. 11
FIG. 12

EXERCISING DEVICE

BACKGROUND OF THE INVENTION

1. Field of the Invention

This invention relates generally to exercising devices and more particularly to a weight-lighting or exercising device wherein the spacing of the weights along the length of the bar and the masses of the individual weights may be selectively varied to accommodate people of different sizes and capabilities.

2. Description of the Prior Art

Weight lifting exercises continue to enjoy ever-increasing popularity among people of all ages, both men and women, girls and boys, and both at home and in the gymnasium. There are hundreds of types of exercising and weight-lifting devices on the market today but by far the most widely used is the barbell-dumbell combination. These devices employ large, ungainly, unsightly, masses which are relatively unportable and inconvenient to use and store. While these types of systems may have been convenient for use in building huge muscles by professional body builders and the like, they do not appear to meet the needs of today.

Today's exercisers use barbells and dumbbells to keep the body in shape and maintain muscle tone without trying to develop the over-muscled physique previously asscoiated with weight-lifting. With both men and women, boys and girls taking an interest in physical fitness, most of the weight-lifting devices of the prior art are no longer suitable. When exercising with barbells or dumbbells, the weight lifter performs many different types of exercises and assumes many different postures requiring balance. Many exercisers, particularly the most inexperienced novices, attempt to lift excessive weights or otherwise lose their balance and drop the weights. This can result in serious bodily harm or physical damage to the floor or other equipment.

Today's weight-lifting devices must be designed for use by many different types of people having different sizes and different capabilities. The weights must be longitudinally adjustable along the bar and the masses of the individual weights must be selectively variable. While several types of weight-lifting devices are known in the prior art in which the mass may be varied by adding or removing a foreign material from the hollow interior portion of the body of the weight, they do not appear to be longitudinally positionable along the length of the bar. Furthermore, present-day needs require that the weights be shaped for maximum safety. All external surfaces should be rounded and the bar should not protrude out of the weight. While the traditional dumbbell configuration is rounded, the weights are not longitudinally positionable along the length of the bar and most dumbbells are not designed for use with barbells. Most of the longitudinal adjustment attained in the prior art is complex and time consuming since the individual weights must be removed from a bar of a first fixed length, placed on a bar of a second length and secured thereto. This is an extremely time consuming method of adjustment.

Additionally, it would be extremely convenient if the weights could be removed from the barbell and used as a dumbbell without attachment to a shorter bar or the like. Even greater convenience is achieved if the removed weight could be used on either the exerciser's hand or his foot without requiring attachments or alterations to the device.

All of these desirable characteristics are achieved in the exercising device of the present invention which allows the spacing of the weights along the length of the bar and the masses of the individual weights to be selectively varied to accommodate people of different sizes and capabilities while simultaneously allowing the weights to be removed from the bar and used as dumbbells on either the hands or the feet of the exerciser without requiring attachments to or alterations of the weights.

SUMMARY OF THE INVENTION

The weight-lifting or exercising device of the present invention employs a pair of subbstantially hollow and generally spherical weight members which may be attached to the ends of the bar. In the prime embodiment herein disclosed, the substantially spherically shaped weights include generally ovoid or egg-shaped shells. Each shell has a first axis, a central aperture transverse to the first axis, and a tubular member aligned with the axis and extending across the aperture. An axial bore or channel is opened at one longitudinal end of the shell and extends along the axis and through the tubular member for telescopically receiving the bar therein. The aperture is adapted to receive a person's hand or foot which may operatively engage the tubular member for exercising purpose. The shells may be totally removed from the bar and used on either the hands or feet as individual dumbbells or the shells may be telescoped along the bar and selectively locked at predetermined spaced locations along its length for barbell applications. The shells include substantially hollow compartments on opposite sides of the aperture which can be filled or emptied of foreign materials such as water, sand, shot or the like to selectively increase or decrease the mass of the individual weights.

In the prime embodiment, the egg-shaped shell and tubular member are integrally formed as a single unitary piece and all external surfaces are smooth and rounded for safety purposes. The end of the bar which is telescopically received in the channel does not protrude out of the opposite end of the shell and the device may be used as a barbell which can be gripped either by the bar itself or, preferably, by the tubular members across the apertures. A spring biased pin is housed within the bar and extends through an aperture proximate the end thereof. A series of spaced and aligned apertures are formed in the tubular member such that the pin may be depressed so that the shell can be slidably positioned to predetermined selected locations along its length whereat the pin protrudes through one of the holes in said tubular member and lockably positions said shell on said bar.

The present invention allows the masses of the individual weights to be selectively varied by increasing or decreasing the amount of foreign material, such as water, sand, shot or the like which is contained within hollow compartments formed in the shell. This allows the masses of the individual weights to be varied to suit the requirements of a wide variety of individual exercisers without requiring that the weights be removed from the bar. This results in a substantial savings in time and energy since the exerciser does not need to find the proper tools, unfasten the weight, remove it from the bar, locate the proper weight, replace it on the bar, and resecure the newly added weight to the bar with the tool. In the present invention, the mass of the weight may be changed merely by removing a plug and adding or removing sufficient foreign material to arrive at the proper mass.

Additionally, the present invention does not require the use of a plurality of bars each having a different fixed length. The present system employs a single fixed length bar and the weights are longitudinally positionable along the length of the bar so as to meet the individual needs of any given exerciser. For the reasons given above, this results in a considerable savings in time and energy; and a savings in storage space, manufacturing costs, and shipping weight. While it may have been possible to clampably position individual weights at various positions along the length of a bar in some of the devices of the prior art, and these devices suffered from either or both of two dificiencies. Either (1) the longitudinal length over which the position of the weight could be varied was very limited or (2) the distal end of the bar protruded from the end of the weight resulting in a potentially hazardous condition.

Safety factors played a major role in the design of the present invention. The generally spherical, ovoid or egg-shaped shells or weights present only smooth rounded external surfaces. The are no dangerous or potentially hazardous protrusions and the weights are easy and safe to use and store.

The individual egg-shaped weights of the present invention represent the ultimate in convenience since they may be removed from the bar used for barbell applications and used directly as a dumbbell without modification or attachment to another bar. There are no bolts or fastening means which must be removed and no clamps which must be attached. Additionally, the individual shells may be used on either the hand or the foot without modification and without attachments to the foot or the weight.

The present invention, therefore, provides a relatively simple, low cost, easy to maintain and store, weight-lifting or exercising device wherein the spacing of the weights along the length of the bar and the masses of the individual weights may be selectively varied to accommodate people of different sizes and capabilities in a convenient, non-time consuming manner while maximizing the safety features of the device. The device is extremely convenient since it may be gripped by either the hands or the feet and because the individual weights may be removed and used as dumbbells on either the hands or the feet without modifications. The safety features, convenience, adaptability, low cost and storage capability of the present invention are not even approached by any of the devices of the prior art.

BRIEF DESCRIPTION OF THE DRAWINGS

These and other advantages of the present invention will become more readily apparent after reading the following written description of a prime embodiment of the present invention in conjunction with the appended claims and the attached drawings in which:

FIG. 1 shows a perspective view of one of the egg-shaped weights adapted for use as a dumbbell;

FIG. 2 shown a pair of the egg-shaped weights of the present invention mounted on a bar to form a barbell configuration of the present invention;

FIG. 3 shows a pictorial illustration of an individual using a pair of the devices shown in FIG. 1 as hand-held dumbbells;

FIG. 4 shows a pictorial illustration of an individual using the barbell configuration of FIG. 2 with his hands engaging the bar portion thereof;

FIG. 5 shows a pictorial illustration of an individual employing the barbell configuration of FIG. 2 and gripping the individual weights rather than the bar portion thereof;

FIG. 6 is a pictorial illustration of an individual exercising by placing his feet into the apertured portions of either a pair of the individual weights of FIG. 1 or into the pair of weights mounted on the bar of FIG. 2;

FIG. 7 is a top plan view of the individual egg-shaped weight of FIG. 1;

FIG. 8 is a front view, partially in section, and substantially along the view arrows 8—8 of FIG. 7 of the individual egg-shaped weight of FIG. 7;

FIG. 9 is an end view of the individual egg-shaped weight of FIG. 7 taken along the view arrows 9—9 thereof;

FIG. 10 is a top view of a pair of the egg-shaped weights of the present invention coupled to a bar in the barbell configuration of FIG. 2 and adjustably positioned to first longitudinal locations along the length of said bar;

FIG. 11 is a top view similar to that of FIG. 10 with the individual weights being adjustably positioned to a second predetermined spaced location along the length of the bar;

FIG. 12 shows a cut-way view of a portion of the barbell bar taken along the direction of the veiw arrows 12—12 of FIG. 11; and FIG. 13 shows a substantially spherical alternate embodiment to the egg-shaped weight of FIG. 1 and may be used in either the dumbell configuration of FIG. 3 or in the barbell configuration of FIGS. 4 and 5.

DESCRIPTION OF THE PREFERRED EMBODIMENTS

FIGS. 1 and 13 show generally spheroidal bodies generally referred to as weights, or, in the embodiment of FIG. 1, as egg-shaped or ovoid shells 21. FIG. 1 shows a weight 21 which can be used directly as a dumbbell as illustrated in FIG. 3. FIG. 2 shows a barbell configuration 23 wherein a pair of the egg-shaped shells 21 of FIG. 1 are coupled to opposite ends of a hollow cylindrical bar 25. FIGS. 3, 4, 5, and 6 show an individual or exerciser 27 using the weight-lifting or exercising devices of the present invention. In FIG. 3, the individual 27 has one of the weights 21 of FIG. 1 in each hand so as to employ the egg-shaped ovoid shells 21 as dumbbells. In FIG. 4, the individual 27 is holding the barbell configuration 23 of FIG. 2 above his head with his hands gripping the cylindrical bar 25 internally of the weights 21. In FIG. 5, the individual 27 has the barbell configuration 23 of FIG. 2 lifted above his head and his hands are gripping the egg-shaped shells 21 rather than the bar 25. FIG. 6 shows an individual 27 with his feet inserted in the weights 21 in either the dumbbell configuration of FIG. 1 or the barbell configuration 23 of FIG. 2.

The egg-shaped or ovoid shell 21 of the prime embodiment of the present invention will now be described with reference to FIGS. 7, 8 and 9. Each egg-shaped shell housing or body 21 has a first longitudinal axis 29 and a central aperture or opening 31 extending through the central portion of the body 21 and oriented transversely of the longitudinal axis 29. A tubular member 33 is located within the interior of the shell 21 and extends along the longitudinal axis 29 across the central aperture 31. The aperture 31 is adapted to receive the hand or foot of the individual 27 which can then engage or grip the tubular member 33 for lifting the weight 31 as known in the art.

An axial bore or channel 35 extends substantially along the longitudinal length of the shell 21 and along the central axis thereof. The channel 35 has at least one channel opening 37 at one longitudinal end of the shell 21 and the other end may contain a similar channel opening 37′ to allow the shell 21 to be used interchangeably on either the left or right end of the bar 25 or it may be closed to prevent the protrusion of the distal end of the bar 25 therefrom.

The tubular member 33 includes a plurality of longitudinally spaced apertures 39 along its length and the shell housing 21 has an annular chamber 41 about either end of the channel 35 on opposite sides of the central aperture 31. The chambers 41 are adapted to receive mass-increasing foreign material 44 such as water, other heavy fluids, sand, aggregate, metallic shot, cement, or the like. The foreign material 44 is introduced through a material-receiving opening 43 and securely retained within the chamber 41 by means of a plug member 45 which secures the opening 43 against leakage. The foreign matter may be introduced into or removed from the annular chambers 41 to selectively increase or decrease the mass of the individual weight 21 as desired to suit the needs of the individual. The annular end chambers 41 are normally interconnected via peripheral side passages 46 so that a single material receiving opening 43 may be utilized so that the foreign material 44 is evenly distributed on both sides of the central aperture. It will, therefore, be observed that the masses of the individual weights 21 of the exercising device of the present invention can be selectively increased or decreased by adding to or subtracting from the foreign material 44 contained within the annular chambers 41.

The longitudinal positioning or spacing of the weights 21 along the length of the bar 25 will be described with reference to FIGS. 10, 11 and 12. FIG. 10 shows a barbell configuration 23 wherein the hollow cylindrical bar 25 has an egg-shaped shell or weight 21 at both ends thereof. The ends of the cylindrical bar 25 are telescopically received within the channel opening 37 and into the channel 35. As seen in FIG. 12, the hollow cylindrical bar 25 has an aperture 47 spaced from the distal end thereof. A C-shaped spring member 49 has its lower end securely anchored to the internal wall of the cylindrical bar 25 at 51 by some means known in the art and its opposite end mounts a detent button for locking member 53. The shape of the spring member 49 normally biases the locking member 53 to protrude out of the aperture 47. When the detent button or locking member 53 is pressed to cause the member 53 to retract into the hollow interior of the bar 25, the egg-shaped shell 21 is free to slide longitudinally on the bar 25. When one of the spaced apertures 39 of the tubular member 33 resides over the aperture 47, the bias of the spring 49 causes the locking member or pin 53 to pass through the aperture 47 and the aperture 53 so as to retainably lock or secure the egg-shaped shell at a predetermined longitudinal position along the length of the bar 25. If a different spacing is desired, the locking member 53 is again depressed and the weight 21 can be slidably adjusted until the desired aperture 39 resides over the aperture 47 so as to cause a proper locking engagement at the desired longitudinal location. A plug or stopper member 55 may be inserted into a distal end of the bar 25 to cushion its contact with the closed end of the shell 21 or to prevent damage if the end protrudes through the opening 37′ during adjustments.

It will, therefore be observed that the weights 21 may be longitudinally positoned along the length of the bar 25 in accordance with the need of the individual 27. If it is desired that the weights 21 be positioned relatively close to one another, as shown in FIG. 10, the locking members 53 may be depressed and the weights 21 slided inwardly along the bar 25 until the locking member 53 engages the desired aperture 39 in the tubular element 33. If a wider spacing were desired, as shown in FIG. 11, the locking member 53 could be depressed and the weights 21 moved outwardly on the bar 35 until the proper aperture 39 could be engaged by the locking member 53 to secure the weights 21 at the desired one of the predetermined spaced locations along the bar 25.

An alternate embodiment of th present invention is shown in FIG. 13 wherein the generally spheroidal body more closely assumes a truly spherical shape. The term "generally spherical" or "spheroidal" bodies refers to either the generally egg-shaped or ovoid shells 21 of FIG. 1 or the substantially spherical shell 57 of FIG. 13. It will be obvious, to those skilled in the art, that the substantially spherical shell 57 of FIG. 13 may similarly be used in either the dumbbell configuration of FIG. 1 or the barbell configuration 23 of FIG. 2. It will also be noted that with either of the embodiments, and with either the dumbbell configuration or the barbell configuration 23, the individual may insert either his hand or his foot within the aperture 31 and either his hand or foot could engage the tubular member 33 for exercising purposes. It will also be noted that the central aperture 31 may be a recess rather than an opening all the way through the central portion of the weight 21. However, in the preferred embodiment, an aperture entirely through the body of the shell 21 is desired for a symmetrical distribution of the mass.

It will also be observed, that in either the dumbbell configuration of FIG. 1 or the barbell configuration 23 of FIG. 2, and with either the generally egg-shaped shell 21 of FIG. 1 or the substantially spherical shell 57 of FIG. 13, only relatively smooth curved surfaces are present. There are no sharp protrusions and, in the preferred embodiment, even if the second channel opening 37′ is present, the relative spacing of the locking member 53 and the apertures 39 is such that even when the shells 21 are locked at their innermost longitudinal position on the bar 25, the distal end of the bar 25 does not protrude therefrom. This greatly increases the safety of the exercising device of the present invention and prevents potentially hazardous conditions. The generally spheroidal shape of the shells 21 and 57 minimize bodily damage to the person and property damage to the floor or associated weight-lifting apparatus due to their shapes. The fact that the masses may be increased selectively is also important from the standpoint of reduced manufacturing and shipping costs, since only one bar 25 is needed, and since the shells 21 and 57 have convenient shapes, the exercising device of the present invention is easily used and easily stored.

The exercising device of the present invention is also easy to adjust and does not require any special tools or time consuming assembly and disassembly operations.

When the shells 21 or 57 are removed from the bar 25 and used as dumbbells, as shown in FIG. 3, there are no bolts or fasteners to remove, re-fasten or put away on either the bar 25 or the shells 21 or 57. The shells 21 or 57 do not have to be attached to some smaller bar for use as dumbbells since the tubular member 33 serves as a handle for dumbbell use. The overall reduction in cost, ease of maintenance, adjustability of both weight and positioning, ease of storage and safety considerations mark the present invention as a significant step forward in the art.

While specific apparatus and shapes have been shown for the purpose of illustrating the prime embodiment of the present invention, it will be readily apparent to those of ordinary skill in the art that various modifications and changes may be made to the apparatus disclosed herein without departing from the spirit and scope of the present invention which is limited only by the appended claims.

I claim:

1. An exercising device adapted for being held in one hand comprising a generally egg-shaped housing having a longitudinal axis and having a central aperture extending through said housing in a direction normal to said longitudinal axis, said aperture being adapted to receive said hand therein, an elongated tubular handle portion interior to said egg-shaped housing and being provided with inner and outer cylindrical surfaces, said handle portion extending from one end of said housing across said aperture to the other end of said housing, said tubular handle portion having an axis which is aligned with said longitudinal axis, said handle portion being adapted to be gripably engaged by said received hand, said housing and said handle portion comprising a single unitary piece, said housing including compartments on both sides of said aperture which are adapted to receive foreign materials for increasing the mass of the deivce, the portion of said handle portion adjacent said central aperture of said housing being provided with a plurality of longitudinally spaced openings which extend through the inner and outer cylindrical surfaces thereof, said openings permitting the exercising device to be adjustably connected to a weight lifting bar.

2. An individual barbell device comprising a generally spherical shell having a first axis and having a central aperture extending through said shell in a direction normal to said first axis, an elongated tubular cylindrical element within the interior space of said shell and being provided with inner and outer cylindrical surfaces, said cylindrical element extending from one side of said shell across said aperture to the opposite side of said shell, said cylindrical element having an axis which is aligned with said first mentioned axis, said shell and said cylindrical element comprising a single unitary piece of molded plastic material, said shell including compartments within the interior space thereof on both sides of said aperture which are adapted to retainably receive mass-increasing foreign matter, the portion of said cylindrical element adjacent said central aperture of said shell being provided with a plurality of openings which extend through the inner and outer cylindrical surfaces thereof, said openings permitting the individual barbell device to be adjustably connected to a weight lifting bar.

3. The device of claim 1 further characterized in that said shell and said element form a unitary integral device having only smooth founded exterior surfaces for increased safety.

4. The device of claim 2 further characterized in that said generally spherical shell is ovoid with said element being aligned with the longitudinal axis of said shell and said aperture extending laterally perpendicular to said longitudinal axis, said compartments being located in the longitudinal end portions of said shell on opposite sides of said aperture.

5. A weight exercising device wherein the spacing of the weights may be selectively varied to accommodate people of different sizes and capabilities, said device comprising:

a bar;

a pair of weights, each of said pair of weights including a generally spherical body and a tubular channel opening on one end of said body for telescopically receiving one end of said bar therein; locking means for selectively securing said weights at a plurality of different positions along the length of said bar such that the telescopically received ends of said bar are never protrudably exposed from said bodies.

6. The device of claim 5 further characterized in that each of said generally spherical bodies has a first axis defined by said channel, an aperture located in a central portion of said body, said aperture being oriented perpendicular to said first axis, and a tubular member oriented along said first axis for defining a channel across said aperture.

7. The device of claim 6 further characterized in that said aperture is adapted to receive a hand therein and said tubular member is adapted to be gripped by said received hand.

8. The device of claim 6 further characterized in that said generally spherical body is sustantially ovoid and said first axis is the longitudinal axis of said ovoid body.

9. The device of claim 6 further characterized in that said bar is a hollow cylindrical member having an aperture adjacent each end thereof, said tubular member includes a plurality of aligned longitudinally spaced apertures along the length thereof, and said locking means includes a locking member biased for protrusion out of the aperture of said hollow cylindrical member, said body being slidably adjustable longitudinally along said cylindrical member when said locking member is depressed and lockably secured when said locking member enters a selected one of the spaced apertures of said tubular member.

10. The device of claim 6 further characterized in that each of said bodies includes a pair of substantially hollow chambers located on opposite sides of said central aperture, said chambers being adapted to receivably retain mass-increasing materials such as water, sand, shot, and the like.

11. The device of claim 6 further characterized in that the portion of said central aperture between said tubular member and the outer wall of said body is adapted to receive a foot for performing exercises with said device.

12. The device of claim 6 further characterized in that said weights are adapted to be removed from said bar for use as dumbbells on the hands and feet.

13. The device of claim 5 further characterized in that said body has its end opposite the end having the tubular channel opening closed to prevent the protrusion of said received bar therefrom.

14. An exercising device wherein both the longitudinal spacing of the weights along an elongated bar and the masses of the individual weights may be selectively adjusted to accommodate people of different sizes and capabilities, said exercising device comprising:

an elongated bar;

a pair of substantially hollow generally egg-shaped shells, each of said shells having a longitudinal axis and including a central aperture through said shell and transverse to said longitudinal axis, a hollow tubular member extending across said aperture and aligned with said longitudinal axis, an axial bore opening on one longitudinal end of said shell and extending along said axis and through said hollow tubular member for telescopically receiving an end of said elongated bar within said bore, said aperture being adapted to receive a body member therein and said tubular member being adapted to be engaged by said received body member, said pair of shells being adapted for use as dumbbells when removed from said bar, each of said shells including hollow compartments on opposite sides of said aperture about said axial bore, said compartments being adapted to contain a selectively variable mass of material for increasing and decreasing the mass of the individual weights; and locking means for selectively locking said shells at predetermined selected space locations along the length of said bar such that the telescopically received ends of said bar are never protrudably exposed from said shells.

* * * * *